US007344421B1

(12) United States Patent
Spencer

(10) Patent No.: US 7,344,421 B1
(45) Date of Patent: Mar. 18, 2008

(54) QUICK RELEASE BATTERY CABLE CONNECTOR

(76) Inventor: Troy L. Spencer, 4854 Fountain, St. Louis, MO (US) 63113

( * ) Notice: Subject to any disclaimer, the term of this patent is extended or adjusted under 35 U.S.C. 154(b) by 90 days.

(21) Appl. No.: 11/439,565

(22) Filed: May 24, 2006

Related U.S. Application Data

(60) Provisional application No. 60/687,276, filed on Jun. 6, 2005.

(51) Int. Cl.
*H01R 4/28* (2006.01)

(52) U.S. Cl. ..... 439/755; 439/286; 439/773; 439/889

(58) Field of Classification Search ..... 439/754, 439/755, 773, 770, 772, 620.26, 620.27, 439/620.28, 620.33, 620.34, 286, 889, 864
See application file for complete search history.

(56) References Cited

U.S. PATENT DOCUMENTS 4,380,291 A * 4/1983 Shannon ..... 206/343
4,508,413 A * 4/1985 Bailey ..... 439/550
4,537,460 A 8/1985 McCaig
4,555,159 A * 11/1985 Chartrain et al. ..... 439/773
4,643,511 A * 2/1987 Gawlik et al. ..... 439/755
4,936,799 A * 6/1990 Woodall ..... 439/755
5,024,619 A * 6/1991 Caraballo ..... 439/755
5,254,020 A 10/1993 Obligar
5,595,510 A 1/1997 Obligar
5,597,331 A * 1/1997 Gable et al. ..... 439/754
6,025,088 A * 2/2000 Kump ..... 429/121
6,152,784 A 11/2000 Pyles
6,287,155 B1 9/2001 Yakovich
6,629,863 B2 10/2003 Kieninger et al.
6,773,310 B2 8/2004 Davis
6,805,593 B2 10/2004 Spaulding et al.
7,172,462 B1 * 2/2007 Gronowicz, Jr. ..... 439/620.26

* cited by examiner

*Primary Examiner*—Neil Abrams
*Assistant Examiner*—Phuongchi Nguyen
(74) *Attorney, Agent, or Firm*—Polster, Lieder, Woodruff & Lucchesi, L.C.

(57) ABSTRACT

A bracket and quick connect/disconnect battery cable connector are disclosed to facilitate connection of a battery cable to a vehicle batter. The bracket is adapted to be connected to a battery to be in electrical communication with a terminal of the battery. The bracket comprises a head having a first surface, a second surface opposite the first surface, and two or more spaced apart lock members extending from the bracket head first surface. The lock members are generally C-shaped forming channels defined by a curved side surface and an upper surface. The connector comprises a body having a surface, a stem extending from the body surface and two or more flanges extending radially from the stem. The flanges have an upper surface spaced from the connector body surface. One of the flange upper surface and the channel upper surface is sloped such that, as the connector is rotated relative to the channel, the locking member radially extending surface will be sandwiched between the flange upper surface and the connector body surface. In a preferred embodiment, the flange upper surface is sloped, such that the flange defines a wedge.

10 Claims, 2 Drawing Sheets

QUICK RELEASE BATTERY CABLE CONNECTOR

CROSS-REFERENCE TO RELATED APPLICATIONS

This application claims priority to U.S. Provisional Patent App. No. 60/687,276 filed Jun. 6, 2005 and which is incorporated herein by reference.

STATEMENT REGARDING FEDERALLY SPONSORED RESEARCH OR DEVELOPMENT

Not Applicable.

BACKGROUND OF THE INVENTION

As is known, battery cables, which connect a car's electrical system to the car battery, include connector ends which are connected to the terminals on the car battery. The cable connector end is often an annular member which fits about the post shaped battery terminal, and includes a screw or other means to tighten the cable connector to the terminal post.

To remove the battery (for, example, to replace the battery), the cables must be disconnected from the battery. To do so, requires that the tightening elements of the cable connector be loosened to allow for the connectors to be removed from the terminal post. Loosening these tightening elements can be difficult and is time consuming.

It would be beneficial if the battery cable connector could be removed relatively easily and without the need for tools.

BRIEF SUMMARY OF THE INVENTION

Briefly stated, in accordance with an aspect of the invention, a bracket is provided which is connectable to a battery and a quick connect/disconnect battery cable connector is provided which can be easily and quickly connected to, and disconnected from, the bracket. The bracket and a battery cable connector are both made from an electrically conductive material (such as aluminum).

The bracket is adapted to be connected to a battery to be in electrical communication with a terminal of the battery. For example, the bracket can be provided with a stem which is matingly received in an opening in the battery to secure the bracket to the battery. The bracket comprises a head having a first surface, a second surface opposite the first surface, and two or more lock members extending from the bracket head first surface. The stem extends from the bracket second surface. The lock members are spaced apart to define a gap therebetween. Each lock member each comprising an axially extending portion and a radially extending portion extending from over the head first surface to define channels. The channels are thus defined by a curved side surface and an upper surface. The radially extending portions of the lock members have an inner edge, and, the inner edges of the lock members, in combination, define a bracket opening.

The connector comprises a body having a surface, a stem extending from the body surface and two or more flanges extending radially from the stem. The stem is sized to fit in the bracket opening. The flanges are sized and shaped to be received in the gap between adjacent lock members. The flanges have a side surface, an upper surface, a lower surface, a leading end and a trailing end. The flange upper surface is space from the connector body surface. The flange has a width, at least at its leading end, sized to be received in the bracket channel. Additionally, a distance between the flange upper surface and the connector body surface is sized to be at least slightly greater than a width of the lock member radially extending portion.

At least one of the flange upper surface and the channel upper surface is sloped such that, as the connector is rotated relative to the channel, the locking member radially extending surface will be sandwiched between the flange upper surface and the connector body surface. In a preferred embodiment, the flange upper surface is sloped, such that the flange defines a wedge.

The cable connecting elements of the connector comprise a clamp at an end of a neck extending from the cable connector body.

BRIEF DESCRIPTION OF THE SEVERAL VIEWS OF THE DRAW

Corresponding reference numerals will be used throughout the several figures of the drawings.

DETAILED DESCRIPTION OF THE INVENTION

Figure 1:
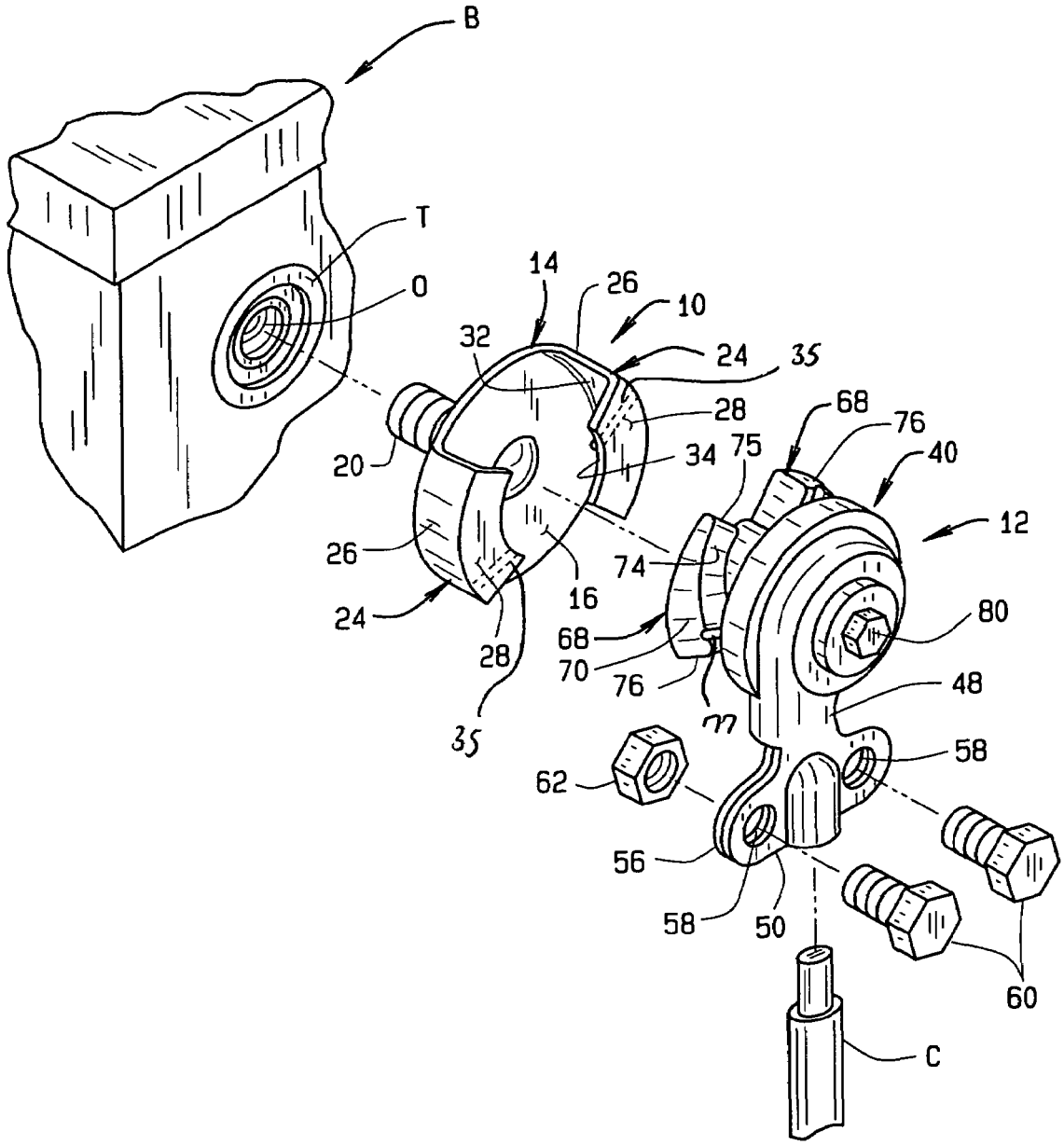
FIG. 1 is an exploded perspective view of a cable connector and associated bracket of the present invention with a vehicle battery.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

An illustrative embodiment of a bracket 10 and cable connector 12, both of which are made from an electrically conductive material (such as aluminum) for connecting a cable C of a vehicle's electrical system to a vehicle battery B is shown in the drawings. As seen in FIG. 1, a battery B has a terminal T shown to be on a side of the battery (as opposed to being on the top of the battery). The terminal T is generally flat (but may be raised relative to the side surface of the battery). An opening O, which is internally threaded extends inwardly from the terminal T. As will be described below, the bracket 10 is adapted to be mounted to the battery so that at least a part of the bracket is in electrical contact with the battery terminal T. The connector 12 is a quick connect/disconnect connector which allows for the vehicle cable C to be placed in electrical connection with the bracket 10, and hence the terminal T, quickly and easily without the use of tools or with only a pliers or wrench.

The bracket 10 includes a head 14 having an upper surface 16 and a lower surface 18. A post 20 extends from the head lower surface 18. The post 20 is adapted to be received in the battery opening O. Hence, the post 20 is externally threaded. However, if the opening O included different connection means (such as an L-shaped bayonet slot, for example), the post 20 would be adapted to mate with the connection means of the battery, such that the bracket could be mounted to the battery. Alternatively, if the opening included a projecting pin, then the post 20 could be provided with an L-shaped slot. The post 20 has a length such that when the bracket is mounted to the battery, a part of the bracket 10, such as the head lower surface 18 will be in electrical contact with the battery terminal T.

Figure 4:
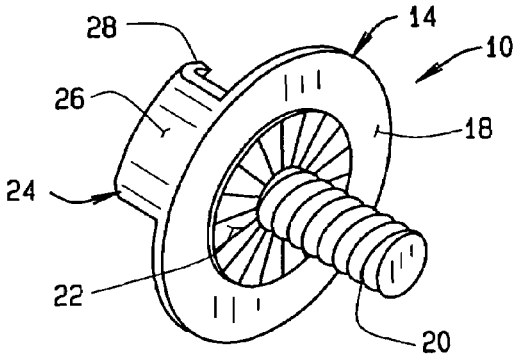
FIG. 4 is a bottom perspective view of the bracket.

The bracket head back surface 18 can have a textured portion 22. As seen in FIG. 4, the textured portion 22 can be raised relative to the head bottom surface 16. Such texturing of the back surface 18 will help lock the bracket 10 in place when the bracket post 20 is tightly screwed into the battery opening O such that vibrations will not loosen the bracket. This will reduce the possibility of the electrical connection between the bracket 10 and the terminal T from being broken. The textured surface 22 also facilitates making and maintaining the connection between the bracket 10 and the terminal T.

Figure 2:
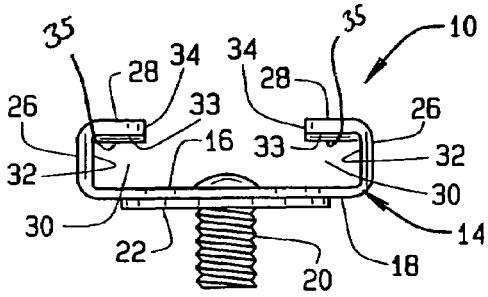
FIG. 2 is a side elevational view of the bracket.
Figure 3:
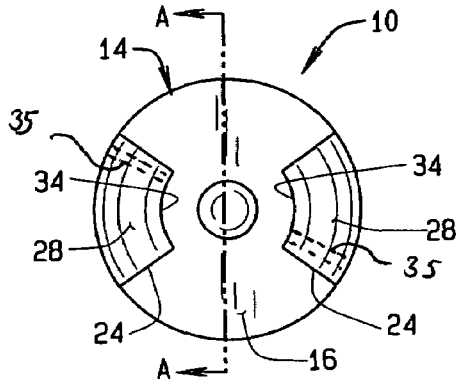
FIG. 3 is a top plan view of the bracket.

A pair of opposed lock members 24 extend from the bracket head upper surface 16 at the periphery of the head. The lock members 24 include an upwardly extending portion 26 and an inwardly extending portion 28 which extends over the head upper surface 16. The lock members 22 thus are generally C-shaped in vertical cross-section, as seen in FIG. 2, and define a arced channel 30 between the lock member upper portion 28 and the head upper surface 16. The channel 30 is defined by a curved side wall 32 and a generally flat upper surface 33. The side wall 32 of the channel 30 defines an arc, as does the inner edge 34 of the lock member upper portion 28. The two opposed lock members 24 face each other, and hence, the channels 30 face each other. The lock members 24 each define an arc of about 80-100°, and preferably about 90°. Hence, there is a space between the lock members. A rib 35 extends generally radially along the channel surface 33 of each of the lock members 24. As seen in FIGS. 1 and 3 (wherein the ribs 35 are shown in dotted lines), the ribs 35 are located generally opposite each other and near an end of the lock members 24. That is, the ribs 35 are located near a forward edge of each of the lock members 24. The ribs 35 extend across the channel surface 33, i.e. from the channel edge 34 to the side wall 32. Hence, the ribs 35 extend generally inwardly relative to the wall 32. Although the ribs 35 are shown to extend generally across the full width of the channel surface, they need only extend across a portion of the surface 33.

The connector 12 includes a connector body 40 having an upper surface 42, a lower surface 44 and a side edge 46. A neck 48 extends from the connector body side edge 46. The neck 48 includes a first clamp member 50 at its end. The clamp member 50 comprises a channel 52 and a pair of oppositely extending ears 54. The channel 52 is sized to receive an end of the electrical cable C. A second clamp member 56 is connectable to the first clamp member to securely hold the cable C between the clamp members. The second clamp member 56 can be flat, or can have a channel positioned to be aligned with the channel 52 of the clamp member 50. The first and second clamp members include aligned openings 58 through which bolts 60 extend to hold the two clamp members together. One of the clamp member openings can be threaded to mate with the threads of the bolt. This would avoid the need to supply the nuts 62. Alternatively, nuts 62 (only one is shown in FIG. 1) can be provided for the bolts. Other desired mechanisms could be used to hold the two clamp members together. Also, other clamping means or mechanisms can be used to secure the end of the cable C to the connector neck 48. As will be appreciated, the connector means will electrically connect the cable C to the connector 12.

A stem 66 extends from the lower surface 44 of the connector body 40. A pair of opposed wedge 68 are formed at the bottom of the stem and extend radially from the stem. The wedges are generally elongate with a curved outer surface 70 that corresponds to the curvature of the bracket channel surface 32. The outer surfaces of the two wedges define arcs of circle having a diameter that is slightly less than the diameter of the circle defined by the arcs of the channel surfaces 32. Hence, the wedges 68 can be rotated (as described below) into the bracket channels 30. The arc defined by the wedges 68 is sized to be received in the area between the bracket lock members 24, such that the wedges 68 can be horizontally aligned with the bracket channels 30. Each wedge defines an arc of about 80° to about 100°, and preferably slightly less than about 90°. As can be appreciated, the number of wedges 68 corresponds to the number of lock members 24, and the wedges 68 are sized to fit between adjacent lock members 24. Although two wedges and two lock members are shown, the number of wedges and lock members could be increased if desired.

Figure 5:
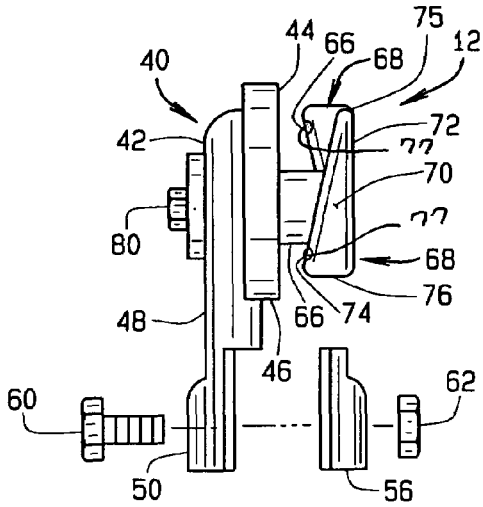
FIG. 5 is a side elevational view of the connector.

The wedges 68 each have a generally flat bottom surface 72, a sloping upper surface 74, a leading or forward edge 75, and an end wall 76 that is generally perpendicular to the bottom surface 74. Thus, the wedges 68 generally define a right triangle in side elevation, as seen in FIG. 5. Hence, the wedges have a first (front) end 75 and a second (back) end 76, with the second (back) end being wider than the front end. The back end has a height that is sized such that the wedge will frictionally engage the bracket channel 30 to secure the connector in the bracket, as will be described below. A groove 77 can be formed in wedge sloped upper surface 74 of each wedge near the wedge end wall 76. The groove 77 extends across the wedge surface, i.e. from stem towards the outer surface 70. Hence, the groove 77 extends generally outwardly relative to the stem 66. Although the groove is shown to extend generally across the full width of the wedge, it need only extend across a portion of the wedge.

Figure 6:
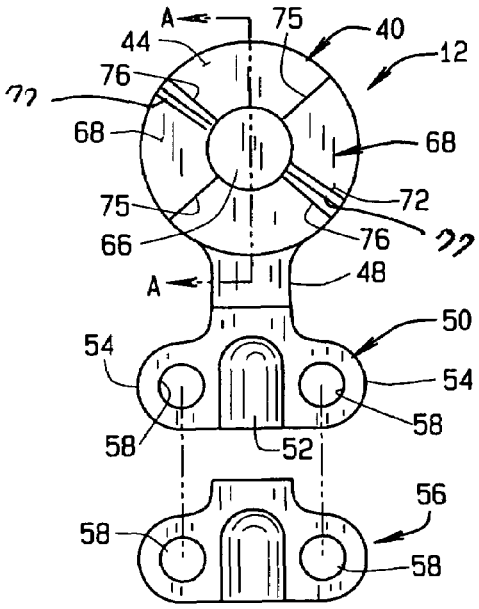
FIG. 6 is a bottom plan view of the connector.

The two wedges 68 face opposite directions when viewed from the side. That is, the front end of one wedge is opposite the back end of the second wedge, and vice versa. Circumferentially, as seen in FIG. 6, the wedges face the same direction, such that, when the connector is rotated, the narrower end of the wedges will be the leading edge of the wedges.

In an illustrative embodiment, the bracket head 14 has a diameter of about 1¼" (about 32 mm). The bracket lock members 24 have a height, from the body bottom surface to the top surface of the lock members, of about ⅝" (about 16 mm). The lock members have a radial width (i.e. from the radial outer edge to the radial inner edge) of about ⅜" (about 9.5 mm). The bracket channel 30 has a height of about ½" (about 13 mm). The connector body 40 has a diameter of about 1¼" (about 32 mm). The connector stem 66 has a length and a diameter of about ½" (about 13 mm). Hence, the opening defined by the lock member inner surfaces 34 is sized to permit the connector stem 66 to be received therebetween. The wedges 68 have a height at the front end of about ⅛" (about 3.2 mm) and a height at the back end of about ⅜" (about 9.5 mm). Hence, there is a gap of about ⅛"

between the top of the wedge back end and the bottom surface 44 of the connector body 40.

Figure 7:
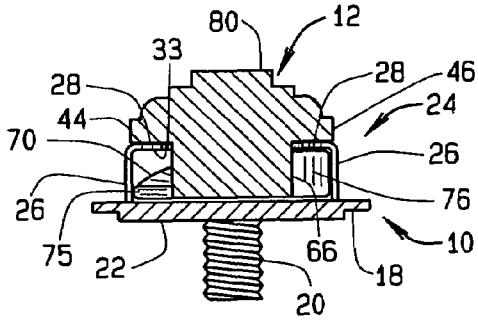
FIG. 7 is a cross-sectional view of the connector received in the bracket, with the bracket and connector being cut along lines A-A of FIGS. 3 and 6.

In use, the bracket 10 is connected to the battery by screwing, or otherwise inserting the bracket post 20 in the battery terminal opening O. As described above, when this is completed, the bracket 10 is in electrical communication with the battery terminal. Preferably, the bracket post 20 is sized such that the bracket head 14 is in electrical contact with the battery terminal T. With the brackets 10 in place, the connector 12 is positioned with the connector wedges 68 in the spaces between the bracket lock members to be in horizontal or planar alignment with the lock member channels 30. The connector 12 is then rotated to slide the wedges 68 into the lock member channels until the connector wedges are wedged in place within the lock member channels. When the connector is rotated, the wedge will engage the upper surface 33 of the bracket channel 30, thereby pulling the connector body lower surface 44 into contact with the lock member upper portion 28, as seen in FIG. 7. Hence, the lock member upper portion will be frictionally sandwiched between the upper surface 74 of the wedge 68 and the lower surface 44 of the connector body 40. The connector is provided with a nut 80 on its upper surface so that a pliers, wrench or the like can be used to facilitate rotation of the connector 12. The frictional wedging action will securely hold the connector in place relative to the bracket and will place the connector 12, and hence the cable C in electrical communication with the battery terminal T by means of the bracket 10.

The ribs 35 and the grooves 77 in the channel 30 and on the wedges 68, respectively, are shaped and positioned, such that, when the wedge is rotated into the connector, the ribs and channels will engage each other to provide a snap-fit engagement between the connector 12 and the bracket 10. This snap-fit engagement supplements the frictional fit between the bracket and connector to reduce the possibility of vibrations within the engine from loosening the connection between the connector and bracket. Although the ribs 35 are shown to be in the bracket and the grooves 77 are shown to be in the connector, it will be apparent that their positions could be reversed, i.e., the grooves 77 could be in the bracket and the ribs 35 could be on the connector. Further, other similar means could be used to positively connect the connector to the bracket. For example, the ribs could be replaced with one or more bumps or even spring mounted balls, and the grooves could be replaced with dimples.

When the battery has to be changed, the connector can be separated from the battery simply by rotating the connector in the opposite direction with draw the connector wedges from the bracket channels. As can be appreciated, connecting the connector to, and disconnecting the connector from, the bracket can be done quickly and with the use of minimal tools. All that might be required would be a pliers, wrench or the like to facilitate rotation of the connector relative to the bracket 10.

As various changes could be made in the above constructions without departing from the scope of the invention, it is intended that all matter contained in the above description or shown in the accompanying drawings shall be interpreted as illustrative and not in a limiting sense. For example, connector neck 48 and stem 66 could define one continuous rod. The bracket and connector could be made with one lock member and one wedge, respectively. Alternatively, the bracket and connector could be made with three or more lock members and wedges, respectively. The nut 80 could be replaced with (or provided with) a slot to receive a screw driver, so that a screw driver could be used to rotate the connector 12. Such a slot could be formed to receive either a flat head or Philips head screwdriver or an Allen wrench. The connector body could be configured to have the cable C connected to the body in different manners. Hence, the cable C could be connected directly to the connector head, and the connector neck could be removed. Although the bracket and connector are shown and described with the wedges on the connector and the channels on the bracket, the position of the wedges and channels could be changed such that the wedges are on the bracket head upper surface and the wedge receiving channels are on the connector. Although the wedges 68 are axially oriented (that is, they change thickness axially relative to the stem 66), they could be radially oriented (that is, they could change shape radially). In this instance, the wedges would engage the channel side surface 32, rather than the channel upper surface 33. It will be appreciated that the channel upper surface 34 could be sloped rather than (or in addition to) the wedge upper surface 74. In this instance, as the wedge (which in this instance could be a flat flange) is moved along the sloped surface of the bracket channel, the connector body would be pulled down onto the locking member upper portion, thereby frictionally sandwiching the lock member upper portion between the connector body lower surface and the wedge (or flange). The ribs and grooves could be omitted, such that the connector is held in the bracket via frictional force alone. These examples are merely illustrative.

The invention claimed is:

1. In combination, a bracket and a battery cable connector; said bracket and battery cable connector being made from electrically conductive material; said bracket being adapted to be connected to a terminal of a battery such that said bracket is in electrical contact with the battery terminal; and said connector being adapted to have an electrical cable be connected thereto;

said bracket comprising a body having a first surface and a second surface and one of a wedge and a lock member; said lock member defining an arcuate channel having a height; said wedge having a narrow end, a wide end and a sloped surface extending between said narrow and wide ends;

said connector comprising a stem and the other of said wedge and lock member extending radially from said stem;

said bracket and said connector being shaped and configured such that said wedge and said channel can be brought into planar alignment; to enable one of said wedge and said channel to be rotated relative to the other; said wedge wide end having a width sized such that said wedge wide end will frictionally engage an surface of said channel when one said channel and wedge are rotated relative to the other.

2. A battery cable connector made from electrically conductive material, said connector comprising:

a body;

a cable receiving member to connect a cable to said connector; and a stem extending from said body; two or more wedges extending from said stem; said wedges having a side surface, an upper surface and a bottom surface; at least one of said surfaces being sloped such that said wedges have a narrow end and a wide end; the narrow end of one wedge being spaced circumferentially behind the wide end of another wedge.

3. In combination, a bracket and a battery cable connector;

said bracket being made of an electrically conductive material and being adapted to be connected to a battery to be in electrical communication with a terminal of the battery; said bracket comprising a head having a first surface, a second surface opposite said first surface, and two or more lock members extending from said bracket head first surface; said lock members being spaced apart to define a gap therebetween; said lock members each comprising an axially extending portion and a radially extending portion extending from said axial portion over said head first surface whereby said lock members define channels, said channels being defined by a curved side surface and an upper surface; said radially extending portions of said lock members having an inner edge, the inner edges of said lock members, in combination, defining a bracket opening;

said connector being made of electrically conductive material and comprising a body having a surface, a stem extending from said surface and two or more flanges extending radially from said stem; said stem being sized to fit in said bracket opening; said flanges being sized and shaped to be received in the gap between adjacent lock members; said flanges having a side surface, an upper surface, a lower surface, a leading end and a trailing end; at least said leading end having a width sized to be received in said bracket channel; said flange upper surface being spaced from said connector body surface a distance at least slightly greater than a width of said lock member radially extending portion;

at least one of said flange upper surface and said channel upper surface being sloped such that, as said connector is rotated relative to said channel, said locking member radially extending surface will be sandwiched between said flange upper surface and said connector body surface.

4. The combination of claim 3 wherein said flange upper surface is sloped, said flange defining a wedge.

5. The combination of claim 3 wherein said bracket further comprises a post extending from said bracket head second surface; said post being adapted to be received in an opening of the vehicle battery adjacent the terminal of the battery, the post being sized and said bracket being configured such that when said post is received in the battery opening, at least a part of said bracket is in electrical contact with the battery terminal.

6. The combination of claim 3 wherein said channel comprises one of a projection and a depression on an inner surface thereof and said flange comprises the other of said projection and depression; said projection and depression being positioned on said channel inner surface and said flange such that said projection is received in said depression when said connector is twistingly received in said bracket.

7. The battery cable connector of claim 6 wherein said wedge upper surface is said sloped surface.

8. The combination of claim 3 wherein said connector further comprises a neck adapted to receive an electrical cable to electrically connect said cable to said connector.

9. The combination of claim 8 wherein the connector comprises a body; said neck and said stem extending from said body.

10. The combination of claim 9 wherein said neck extends from a side of said body and said stem extends from a bottom surface of said body.

* * * * *